US005443256A

United States Patent [19]

Ertavi et al.

[11] Patent Number: 5,443,256

[45] Date of Patent: Aug. 22, 1995

[54] PROCESS AND DEVICE FOR THE FORMATION OF A SCALE-LIKE STREAM OF FOLDED PRINTED COPIES

[75] Inventors: Tibor Ertavi, Kirchberg; Roger Müller, Muri, both of Switzerland

[73] Assignee: Maschinenfabrik WIFAG, Bern, Switzerland

[21] Appl. No.: 171,103

[22] Filed: Dec. 21, 1993

[30] Foreign Application Priority Data

Dec. 28, 1992 [DE] Germany ..... 42 44 343.1

[51] Int. Cl.[6] ..... B65H 29/04

[52] U.S. Cl. ..... 271/277; 271/204; 271/205

[58] Field of Search ..... 271/277, 275, 182, 202, 271/204, 205, 206; 198/465.4

[56] References Cited

U.S. PATENT DOCUMENTS

| | | | |
|---|---|---|---|
| 4,203,590 | 5/1980 | Blessing | 271/277 X |
| 4,799,664 | 1/1989 | Burger | 271/277 |
| 5,088,404 | 2/1992 | MacConnell et al. | 271/204 X |
| 5,102,111 | 4/1992 | Reponty | 271/202 X |

FOREIGN PATENT DOCUMENTS

| | | |
|---|---|---|
| 0067399 | 12/1982 | European Pat. Off. . |
| 0429884A1 | 11/1990 | European Pat. Off. . |
| 2387181 | 11/1978 | France . |
| 680560 | 8/1939 | Germany . |
| 2811467 | 8/1986 | Germany . |
| 3603781 | 11/1989 | Germany . |
| 3735303 | 5/1991 | Germany . |
| 4119511 | 12/1992 | Germany . |
| 580531 | 10/1976 | Switzerland . |
| WO92/02442 | 2/1992 | U.S.S.R. . |

*Primary Examiner*—David H. Bollinger
*Attorney, Agent, or Firm*—McGlew and Tuttle

[57] ABSTRACT

A process for the formation of a scale-like stream of folded printed copies wherein the printed copies are delivered directly to claws from a folding jaw cylinder and are transported onward while being held by the claws. An apparatus for the formation of a scale-like stream of folded printed copies possesses a traction device—for example a toothed belt—by means of which the printed copies are transported onward from a folding jaw cylinder. The traction device is provided with claws for accepting and holding the printed copies in a grasping manner during transportation.

31 Claims, 6 Drawing Sheets

PROCESS AND DEVICE FOR THE FORMATION OF A SCALE-LIKE STREAM OF FOLDED PRINTED COPIES

FIELD OF THE INVENTION

The present invention relates to a process and a device for the formation of a scale-like stream of folded printed copies using a traction device for transporting printed copies from a folding jaw cylinder.

BACKGROUND OF THE INVENTION

Folded printed copies are usually delivered to a paddle wheel from a folding jaw cylinder before they are laid out—subsequent to further delivery steps—to give a scale-like stream and are transported onward. After the opening of such folding jaws on a folding jaw cylinder, the printed copies are held on the folding jaw cylinder by means of a guide belt prior to delivery to the paddle wheel. The printed copies then drop, in a free-fall mode, into the scoops of the paddle wheel. In the case of so-called double production, in which a printed copy comes to lie in each pair of folding jaws of the folding jaw cylinder. The momentum which is imparted by the folding jaw cylinder to the printed copy is often not sufficient to hurl the printed copy as far as the bottom of the scoop whereas, in the case of so-called collection-production, in which only every second folding jaw is overlaid with a printed copy, the printed copies are hurled into the scoops with an undesirably high momentum and become compressed in this way. This is due to the feature that, in the case of collection-production, the paddle wheel is driven at a lower speed than in the case of double production whereas the speed of the cylinder with the folding valves is the same in both cases. The length of the scoops can be optimized only with respect to one type of production or it represents a compromise between the two types of production which is never quite satisfactory. In addition to this problem of the speed difference, the unsatisfactory transportation of the printed copies up to the point of their accommodation in the scoops of the paddle wheel is also problematic during delivery of the printed copies to a paddle wheel. During the course of delivery, as is known, the printed copies are transported exclusively via momentum and are moved, in a free-fall mode, from the folding jaw cylinder into the scoops only because of their inertia. In addition, at least one further delivery step is necessary to a transporter, which is arranged in series thereafter, for laying out the printed copies in a scale-like stream.

An arrangement without a paddle wheel for the acceptance of printed copies from a folding jaw cylinder and for laying out these printed copies in the form of a scale-like stream is known from EP 0 429 884 A1. In the case of this arrangement, the printed copies are taken off the folding jaw cylinder by means of a stripper. A first transportation unit—by means of which the printed copies which have been taken off are transported onward at the conveying speed of the printing machine which is installed in front thereof—is arranged behind the folding jaw cylinder. In this first transportation unit, the printed copies follow one another at a separation which corresponds to their separation on the cylinder with the folding valves. The printed copies are delivered from the first transportation unit to a second transportation unit, which is driven at a lower speed. This allows the printed copies to be transported onward by the second transportation unit in a mutually overlapping manner in the form of a scale-like stream. In both transportation units, the printed copies are, in each case, conveyed between two transportation belts which are arranged parallel, one above the other, at a distance. The delivery of the printed copies to the second transportation unit from the first transportation unit is problematical. During delivery, the printed copies are not transported in a defined manner. It is precisely in this phase that the copies have to be simultaneously slowed down from the high speed of the folding jaw cylinder to the lower speed of the scale-like stream which is to be transported onward. Deceleration can take place only after delivery, i.e. after the printed copy, which has just been delivered, has come to lie on the printed copy which preceded it. In each transportation unit, two horizontal conveyors are also necessary. These conveyors are driven at the same speed, in each case, in order to transport the printed copies. This necessitates high costs in terms of synchronization.

SUMMARY AND OBJECTS OF THE INVENTION

It is an object of the invention to avoid or, as the case may be, to reduce the disadvantages which are associated with methods and devices of the prior art. In particular, folded printed copies should be transported in a defined manner from their delivery from a folding jaw cylinder up to the point of laying out the copies in the form of a scale-like stream. In this connection, the construction cost and the space requirement, which are required should be as low as possible.

According to the invention, a process is provided for the formation of a scale-like stream of folded printed copies. The process includes delivering the printed copies directly to claws from a folding jaw cylinder and transporting the printed copies onward while the printed copies are held in a grasping manner by the claws. The claws are preferably driven continuously at a transportation speed which is 20–40% and more preferably 30–35% lower than a circumferential speed of the folding jaw cylinder. The printed copies are transported while being held by the claws up to the point of laying the printed copies out in the scale-like stream. The printed copies are held at their leading extremities by the claws and a frictional force is exerted on a trailing extremity of the printed copy, during the course of release of the printed copy. The printed copies are transported against stops in an aligned manner during the course of release of the printed copies from the claws up to the point of laying the printed copies out in the scale-like stream. The transportation speed of the printed copies is changed only a small degree upon laying out the printed copies in the scale-like stream.

The invention further includes the device for forming the scale-like stream of folded printed copies including a traction device provided with claws for accepting and holding the printed copies during transportation. The printed copies are transported from a folding jaw cylinder to the traction device. A slot-like intake for the printed copies is formed between the traction device and a claw whereby the printed copies are pressed against the traction device by the claws. The slot-like intakes are open at a trailing extremity of the claws. In an intake zone, the claws are bent in a concave manner relative to the traction device. The claws are connected to the traction device at a leading zone. The claws are preferably connected rigidly to the traction device. Further, the claws are preferably constructed in one piece.

As a result of the process in accordance with the invention, in which printed copies are delivered from a folding jaw cylinder directly to claws and are transported onward by the claws while holding them clamped, the use of a paddle wheel can be dispensed with. The advantage with respect to the arrangement without a paddle wheel in accordance with EP 0 429 884 A1 resides in the use of claws by means of which the printed copies are taken off directly from the folding jaw cylinder and are held permanently clamped during further transportation. This individual acceptance, by means of claws, directly from the folding jaw cylinder makes possible an instantaneous reduction in the speed of transportation of the printed copies since the printed copies no longer have to be transported one behind the other, in a manner which consumes space, on a horizontal conveyor with the consequence that such a horizontal conveyor essentially has to have the same speed as the folding jaw cylinder. Undefined free falling of the printed copies, as in the known case of delivery to a paddle wheel, cannot occur either. Immediately after their release from the folding jaws on the folding jaw cylinder, the leading extremities of the printed copies can be grasped from behind by the claws as a result of which delivery/acceptance takes place, as one might say, in a "hand-shake" process.

The printed copies are already advantageously decelerated by 20 to 40% or, especially, by about 30 to 35% on acceptance from the folding jaw cylinder.

The process in accordance with the invention makes possible the transportation of the printed copies by means of claws up to the point of laying out in the scale-like stream for which purpose the printed copies, which are still being held by the claws at their leading extremities but which are at least still being conveyed, merely need to slide out of the preceding claws via a braking force acting on their trailing extremities and become laid out in the scale-like stream which is being conveyed in the same direction.

In a preferred form of embodiment of the invention, the printed copies are also conveyed against stops during the course of their release from the claws for the purpose of defined alignment in the scale-like stream; the stops are driven at approximately the same speed as the conveyer for the scale-like stream which is to be transported onward.

In the case of a device in accordance with the invention for the formation of a scale-like stream of folded printed copies, the printed copies are transported onward from the cylinder with the folding jaws by means of a traction device—for example a chain or, especially preferably, a toothed belt. In this connection, the printed copies do not lie on the traction device and, in addition, they do not have to be conveyed onward between two transportation belts which have to be synchronized. In accordance with the invention, the traction device is provided with claws by means of which the printed copies are accommodated during the course of acceptance from the folding jaw cylinder and are held in a clamped manner during their subsequent transportation. As a result, individual and, at the same time, continuous acceptance of the printed copies are ensured.

Although claws with a special mechanism for opening and closing the jaws of the claw could basically be employed—for example, claw jaws held together by means of a return spring or claw jaws which are controlled by means of forced control via a connecting link—the claws which are linked to the traction device are arranged in such a way in accordance with the invention that a slot-like intake is formed between the individual claws, in each case, and the traction device for the printed copies. The printed copies are pressed against the traction device by the claws which are preferably fang-like. This collaboration in accordance with the invention between the traction device and the claws constitutes an especially simple constructional solution. The claws are preferably attached rigidly to the traction device. It has also proven to be advantageous to construct the claws in one piece and to produce the clamping force which is exerted on the printed copies exclusively via the elastic restoring forces which are set up between the traction device and the claws. It is especially advantageous to construct the traction device elastically—especially in the form of a toothed belt—and to make use of a hard material—preferably a metallic material—for the claws. A belt with a glass fiber tensile intermediate layer or a belt with steel cord tensile supports and an abrasion—resistant polyurethane coating is suitable as a traction device.

In accordance with the invention and during the course of acceptance of the printed copies, the traction device is transported in an arc, which is curved in a convex manner relative to the folding jaw cylinder, whereby the radius of curvature increases after accommodation of the printed copy. As a result of this transportation of the traction device, the trailing extremities of the claws for accommodating the printed copies are turned away from the traction device and, as a consequence of the subsequently increasing radius after accepting a printed copy, they are again applied to the traction device—and hence to the printed copy—so that the printed copy becomes securely grasped. Although it would basically be possible to lead the traction device over several turn-around rollers in order to produce this curved transportation, it has proven to be completely adequate—and especially advantageous—to convey the traction device on a simple circular arc around a turn-around pulley. During the course of acceptance of the printed copies, the radius of curvature is, accordingly, constant and becomes promptly larger at the end of the turn-around at the point of transition into the linear transportation trajectory.

The turn-around pulley can be formed by a roller or by several turn-around pulleys rigidly connected together on a shaft whereby the position of the axis of rotation for the turn-around pulley is capable of being freely selected in the circumferential direction relative to the axis of rotation of the cylinder with the folding valves. In the latter case, accordingly, use is made of several toothed belts which run parallel to one another. The individual belts are especially expediently connected to one another by means of rigid transverse links. Several claws sit parallel to one another on the transverse links as a result of which comb-like claw edges are formed. It has also proven to be advantageous to bring the claw edge itself into direct engagement with the toothed pulleys, via a specially constructed tooth, in order to convey and stabilize the claws, in a manner which is defined with respect to shape, in the region of acceptance of the printed copies.

In accordance with the invention, the profile of the radius of curvature for the curved transportation of the traction device is capable of being changed on adapting to the different thicknesses of printed copies which are to be accepted. Since closure of the claws takes place by, for example, shortening the curved transportation of the traction device at an earlier point in time, thinner printed copies can also be grasped securely.

A guiding device or, as the case may be, a guide tongue is arranged below the traction device in order to lead the trailing extremities of the printed copies—which hang downward from the traction device or, as the case may be, the claws—whereby the guide tongue reaches into the zone of acceptance of the printed copies following the curved transportation of the traction device.

At the end of the transportation trajectory, the printed copies, which are still being held by the claws, are slowed down and are laid out on a further transporter, which is arranged below the traction device for the claws, in the form of a scale-like stream. In order to release the printed copies, the traction device is again turned away in an arc from the transporter for the laid out printed copies so that, in accordance with the invention, the trailing extremities of the claws spread out on entering the curve of the traction device. At the same time, the printed copies are slowed down by a brake for the copies, which acts on their trailing extremities, as a result of which the leading extremity of the decelerated printed copy is drawn out of the claws, which are moved continuously onward, and is laid out in the scale-like stream. As a result of laying out the printed copies in accordance with the invention in which the leading extremities of the printed copies are still accommodated by the claws—whereas a braking force is already being exerted on the trailing extremities—any compression of the printed copies can be obviated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
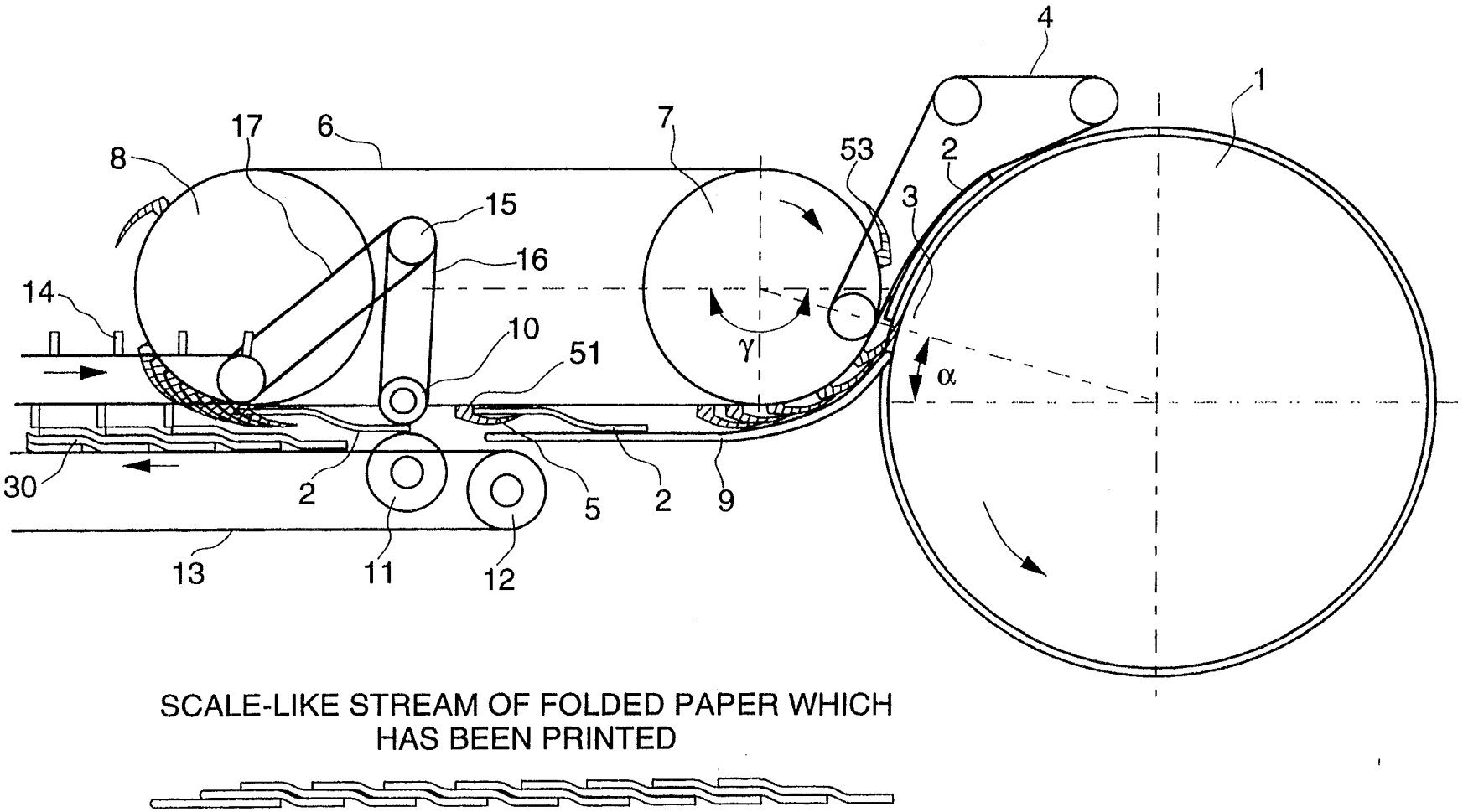
FIG. 1 is a lateral view of a device for the formation of a scale-like stream of folded printed copies.

In FIG. 1, a printed copy 2 is delivered from a folding jaw cylinder 1, which is rotating counter-clockwise, to a traction device. The traction device is provided with claws 5. The printed copy is then laid out on a laying out belt 13 in the form of a scale-like stream 30. A conventional, commercially available toothed belt, which is made from an elastic material with a suitable intermediate tensile layer, serves as the traction device 6—for example a belt with intermediate glass fiber tensile layers or similar intermediate tensile layers —and runs continuously around a first toothed pulley 7 which faces the folding jaw cylinder 1 and around a second toothed pulley 8 in a counter-clockwise direction. The folding jaw cylinder 1 and the toothed pulley 7 facing it therefore rotate in opposite directions (counter clockwise and clockwise) so that they essentially have the same direction in relation to their velocity during the course of delivery/acceptance of a printed copy 2 to a claw 5 from the folding jaw cylinder 1.

Prior to delivery and during the course thereof, the printed copy 2, which is grasped at its leading extremity between the folding jaws 3, is pressed against the surface of the folding jaws cylinder 1 by a guide belt 4 and is transported securely as a result of this. During the course of delivery or, as the case may be, acceptance of the printed copy 2, the claws 5 which are transported over the first toothed pulley 7 engage with appropriate removed portions on the surface of the folding jaws cylinder 1 which, in the example of the embodiment, are constructed in the form of circumferentially progressing grooves. The transportation speed of the toothed belt 6 is approximately 30 to 35% lower than the circumferential speed of the folding jaws cylinder 1. During the course of acceptance of the printed copies 2, which are still lying on the folding jaws cylinder 1, the claws 5 are therefore out-distanced and, during the course of acceptance, they grasp from behind the leading extremity of a printed copy which is about to be delivered. From the moment of release of the printed copy 2 by the folding valves 3 up to the grasping of the leading extremity of the printed copy 2 by a claw 5, the printed copy 2 is transported in the first instance by means of the guide belt 4 and, because of its higher speed, it comes to lie in this way with its leading extremity in the bottom of the claw 5.

As a result of the convex nature of the curvature in the toothed belt 6 relative to the folding jaws cylinder 1, a cyclic harmonic progression arises for the delivery or, as the case may be, the acceptance of the printed copies 2. The first toothed pulley 7 is arranged in such a way with respect to the folding jaws cylinder 1 that its axis of rotation lies in a position which is displaced from the axis of rotation of the folding jaws cylinder 1. The angle $\beta$ is selected in such a way that, on the one hand, it ensures an adequately long time of engagement of the claws 5 with the removed portions on the cylinder 1 with the folding jaws but that, on the other hand, it produces a deflection of the printed copies 2 which is as small as possible. The foremost turn-around roller of the guide belt 4 also possibly lies in this connecting line. In addition, the folding valves 3 are opened shortly prior to, or during, passage through this line.

During the crossing over of the toothed belt 6 from the first toothed pulley 7 into the subsequent linear transportation trajectory up to the second toothed pulley 8, the leading extremity of the printed copy 2, which lies in the bottom of the claw, is compressed ever more strongly against the toothed belt 6 by the trailing extremity of the claw 5 and, in this way, it becomes grasped between the toothed belt 6 and the trailing extremity of the claw 5.

For this purpose and in conjunction with the toothed belt 6, the claw 5 forms a slot-like intake 53 for the printed copies 2 which is open at the trailing extremity of the claw 5. The claw 5 is rigidly attached to the toothed belt 6 in its leading zone. The trailing zone of the claw 5 possesses a profiled shape which is curved in a concave manner relative to the toothed belt 6 so that the claw 5 grasps the belt 6 in a fang-like manner. In addition, the curved profiled shape is especially beneficial for transportation of the printed copies 2 during their acceptance by the claws 5. Basically, however, a claw 5 is capable of being used whose trailing zone runs, for example, linearly and parallel, at a distance, relative to the toothed belt 6 and possesses a bulge-like thickened portion for grasping the printed copies. The claws 5 are made in one piece from a harder material than that used for the toothed belt—in particular a metallic material. The force which is necessary to grasp a printed copy is therefore produced, in the first instance, via the elastic restoring force of the toothed belt 6.

Figure 2:
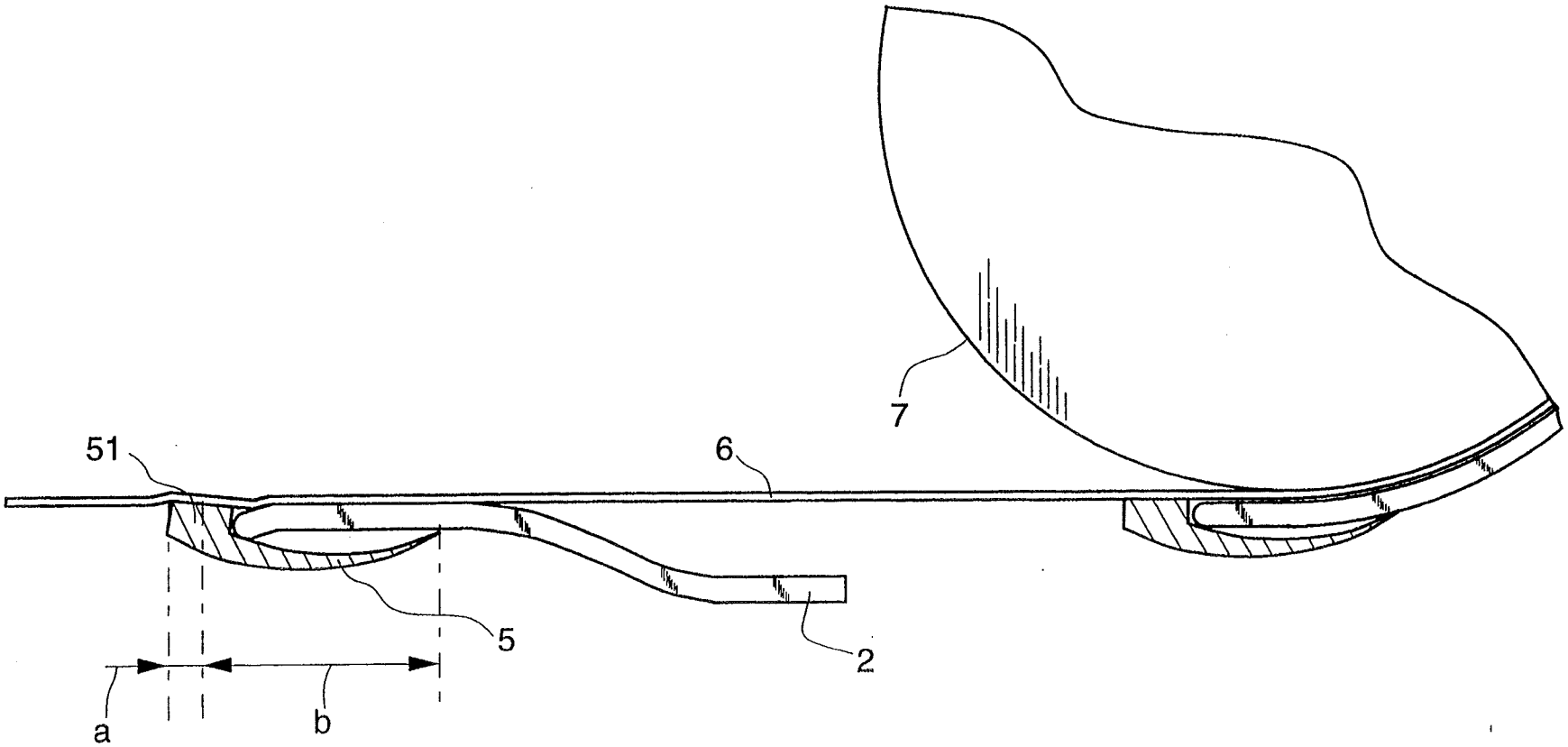
FIG. 2 is a claw with a printed copy which has been grasped.
Figure 3:
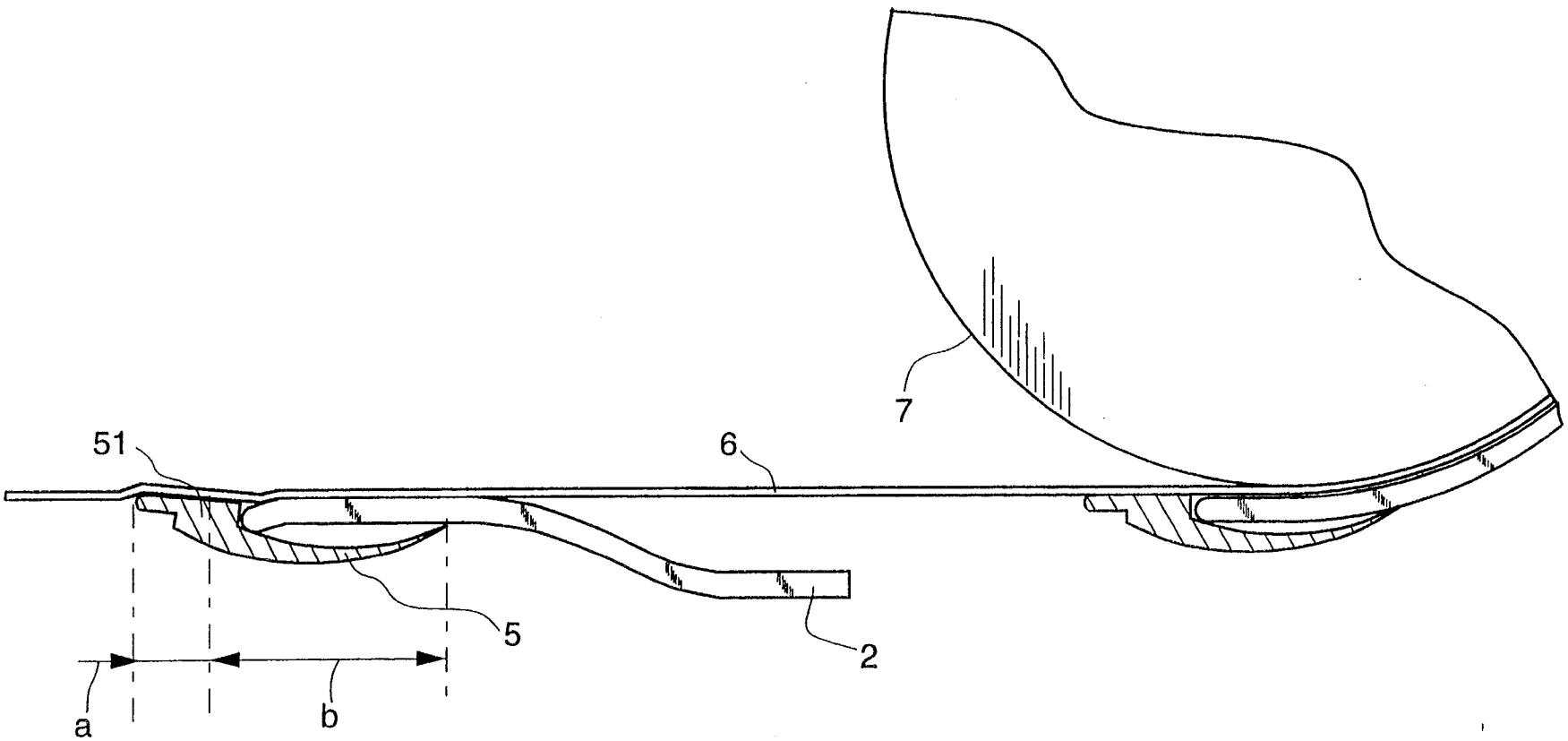
FIG. 3 is a claw with a lengthened front edge.

As can be seen from a comparison of the two examples of embodiments of claws 5 which are illustrated in FIGS. 2 and 3, the elastic grasping force is essentially determined by the separation a of the leading edge of the claw 5 from its axis of rotation. The claw 5 in FIG. 3 possesses a lengthened leading edge with a correspondingly larger separation, or as the case may be, leverage distance a relative to its axis of rotation. A larger grasping force can be exerted by the claw 5 in accordance with FIG. 3 than by the claw 5 in accordance with FIG. 2. During the grasping of the printed copy 2, the torque—which is formed from the product of the force due to the weight of the printed copy 2 and the leverage b—that acts about the axis of rotation is balanced by the elastic restoring force of the toothed belt 6 which acts over the leverage distance a. Thus the restoring moment of the arrangement comprising the toothed belt 6 and claws 5—and hence the grasping force for grasping the printed copy 2—can be adjusted by appropriate lengthening of the leverage distance a and can also be maintained—particularly in the case of less elastic extension or, as the case may be, veering out of the toothed belt 6.

After the toothed belt 6 in accordance with FIG. 1 has run from the straight upper transportation trajectory onto the driven toothed pulley 7, the separation between the trailing extremity of the claw 5 and the toothed belt 6 increases continuously on further turning around of the toothed belt 6 up to the point in time at which the trailing extremity of this claw 5 has passed by the turn-around position of the toothed belt 6. After this, the distance between the trailing extremity of the claw 5 and the toothed belt 6 remains constant until the toothed belt 6 is again moved out of the turn-around zone of the toothed pulley 7 into the lower linear transportation trajectory. The driven toothed pulley 7 is arranged sufficiently closely to the folding jaw cylinder 1 that, during the course of acceptance of a printed copy 2, the claw 5 engages with an appropriately constructed removed-portion on the folding jaws cylinder 1 via its free trailing extremity. In order to accept the printed copy 2, the claw 5 grasps from behind the leading extremity of this printed copy by means of its trailing extremity. Because of the fact that the driven toothed pulley 7 and the folding jaws cylinder 1 are running in opposite directions (clockwise and counter clockwise), the printed copy 2 and the claw 5 move in approximately the same direction during the course of delivery or, as the case may be, acceptance of the printed copy 2, whereby the printed copy 2 is transported at a speed which is about 30 to 35% higher than that of the claw 5. The printed copy 2 is therefore pushed into the bottom of the claw at this speed. Even during this pushing-over phase—or even only starting from the point in time at which the leading extremity of the printed copy 2 in question comes to lie at the bottom of the claw 5—the claw 5 is being moved out of the turn-around zone into the linear transportation trajectory. During this transition, the distance between the toothed belt 6 and the trailing extremity of the claw 5 automatically becomes smaller in magnitude once more and the printed copy 2, which has been accepted, is grasped between the toothed belt 6 and the claw 5. A continuous closing process and a continuous grasping process take place from the outward flow of the printed copy 2 from the axis of rotation of the claw 5 up to the outward flow from the trailing extremity of the same claw.

Figure 4:
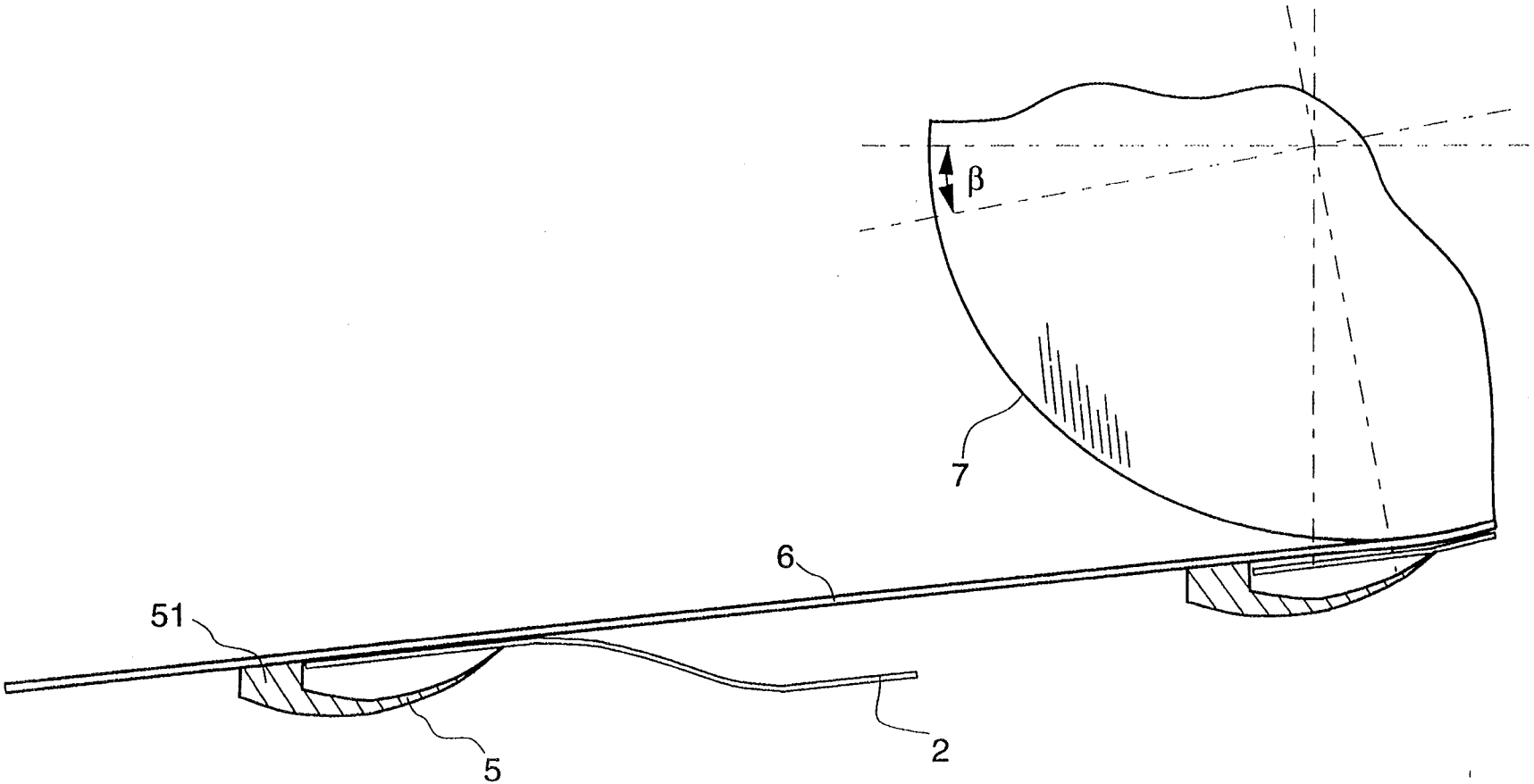
FIG. 4 is a device which has been pivoted away from its previous alignment.

In order to be able to deal with the delivery or, as the case may be, the acceptance of printed copies 2 of different thicknesses, the position of the second toothed pulley 8 is adjustable with respect to the first toothed pulley 7. For this purpose, the second toothed pulley 8—together with the entire arrangement which is necessary for laying out the printed copies—can be swivelled out about the axis of rotation of the first toothed pulley 7. In FIG. 4, a schematic representation is given of swivelling out by an adjustable angle $\beta$. This adjustment brings about the feature that, after the acceptance of a printed copy 2 has taken place, the claw 5—which is already displaced relative to the horizontal arrangement of the two toothed pulleys 7 and 8 by the adjusting angle $\beta$—runs out of the turn-around zone of the first toothed pulley 7 at an earlier stage and, in this way, grasps the accepted printed copy prematurely. As a result of this adjustment of the second toothed pulley 8 relative to the first toothed pulley 7, the clamping of the claws 5 can be adjusted in a continuous manner to any current thickness of the printed copy. On adjusting for thin printed copies 2, adjustment takes place—as shown in FIG. 4—downward relative to the horizontal position. Adjustment for thick and thin printed copies 2 upward and downward about a horizontal central position is also possible.

A guide tongue 9 is arranged below the toothed pulley 6 which extends on one side up into the course of acceptance of the printed copies 2 and engages with removed portions on the cylinder 1 with the folding valves by means of its front extremity and projects into the zone of the laying out belt 13 which is arranged under the toothed belt 6 below the linear onward transportation trajectory of the toothed belt 6. The guide tongue 9 is arranged at such a distance relative to the toothed belt 6 that secure transportation is constantly ensured of the free trailing extremities of the printed copies 2.

In order to lay out the scale-like stream 30, the printed copies 2 are fed in between a brake disk 11 and a cam 10 which acts against the brake disk 11 and are briefly grasped at their trailing extremity between the cam 10 and the brake disk 11 and are decelerated in this way. The transportation through the claw 5 and deceleration by means of this brake for the copies are synchronized in such a way that the claw 5 is already located in the curvature zone of the second toothed pulley 8 and is thus already no longer exerting a clamping force on the printed copy 2 but still transports this printed copy securely at its leading extremity when the cam 10 presses the trailing extremity of the same printed copy 2 against the lower brake disk 11. The printed copy 2 is thereby decelerated to the speed of the laying out belt 13 and—after its trailing extremity has passed by the brake for the copy—it falls out of the claw 4, which runs on further around the second toothed pulley 8, into the scale-like stream.

In order to further improve the alignment of the printed copies 2 which are to be laid out, a cam belt with projecting cams 14 is arranged above the scale-like stream which is forming. The cams 14 serve as stops for the printed copies 2 which have already been released but which have not yet been taken up in the claws 5. The brake-cam 10 and the stop-cams 14 are driven by the toothed pulley 15 via a toothed belt 16 or, as the case may be, a toothed belt 17. The drive speeds, in each case, and the distances between the stop-cams 14 on the cam belt are set in such a way that the printed copies 2 can be drawn through up to the point of braking under the brake-cam 10. The number of revolutions per unit time at which the toothed pulley 15 is driven is adjustable in order, for example, to make it possible to convert from double production to collection-production for the printed copies 2.

The circumferential surface of the brake disk 11 is elastic whereas the brake-cam 10 is made from a material which is harder relative thereto—for example a metallic material. The brake disk 11 can be formed from a foam-rubbery material or it can be coated with such a material so that the brake for the copies adapts itself to varying thicknesses of the printed copies 2 without any mechanical adjustment being required.

Because of the fact that the transportation speed of the toothed belt 6 is lower by 30 to 35% relative to the folding jaw cylinder, the claws 5 possess a mutual separation which is also smaller by about 30 to 35% than that of the folding vanes 3 on the cylinder 1 with the folding valves. The circumference of the toothed pulley 7 is found from the whole number of multiples of the separation between the claws. In the example of an embodiment, the circumference of the toothed pulley 7 corresponds to three times the value of the claw separation: this would permit a displaced arrangement of the claws 5 at a mutual separation of 120° over its surface. In addition, the toothed pulleys 7 and 8 which are used in the example of an embodiment possess the same diameter. The separation of the axis of rotation of the two toothed pulleys 7 and 8 corresponds to half the difference between the length of the toothed belt and the circumference of one toothed pulley whereas the length of the toothed belt is found from the product of two adjacent claw edges 51 and the number of claw edges which are selected.

Figure 5:
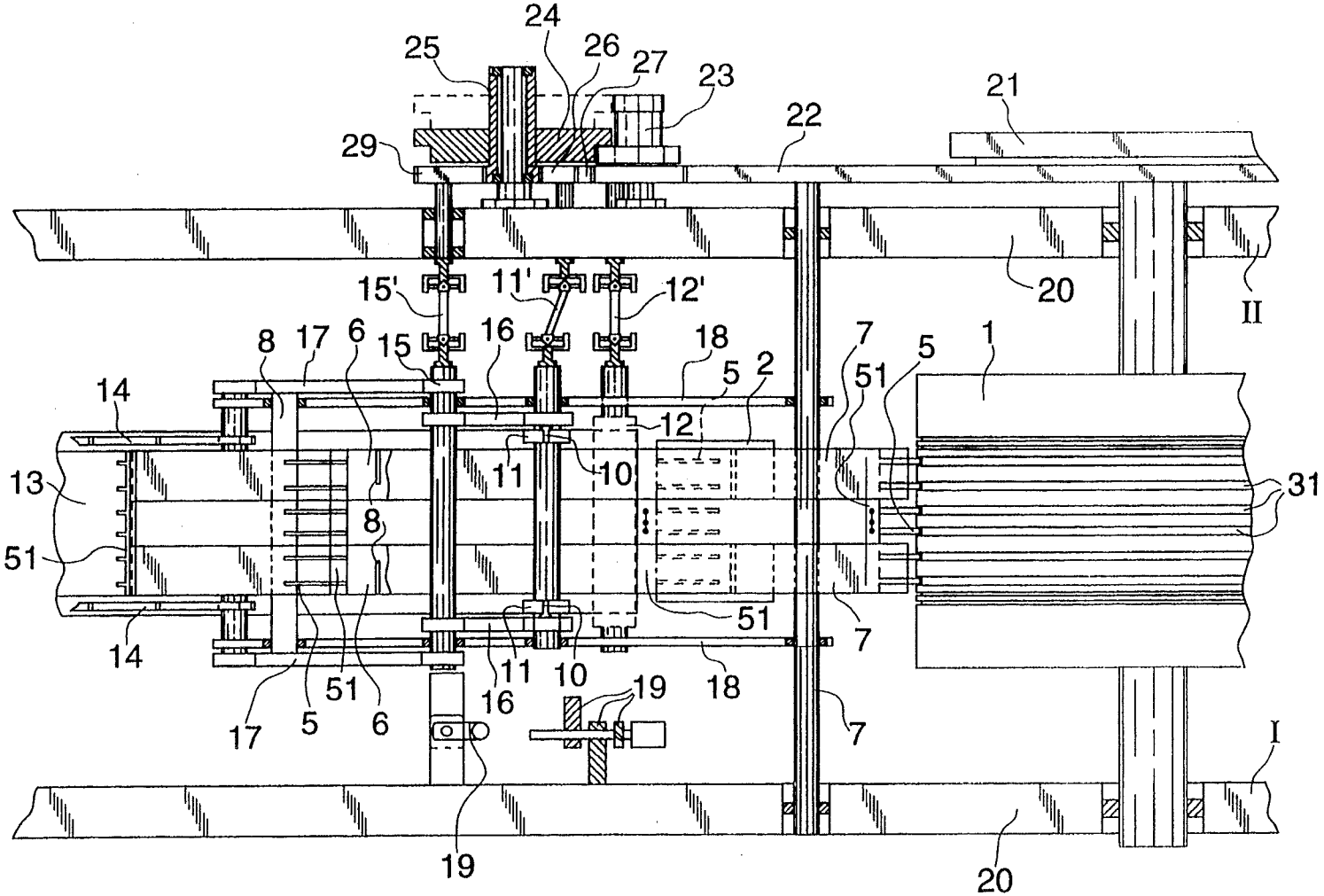
FIG. 5 is a view from above of the device in accordance with FIG. 1.

In the view from above in FIG. 5, an illustration is given of the disposition of the entire arrangement—consisting of the folding jaw cylinder 1, the two toothed pulleys 7 and 8, the laying out belt 13, the brake for the copies and the stop-cam belt—in a frame 20 which essentially comprises two side walls I and II. The two toothed pulleys 7 and 8 are formed by two individual pulleys 7 and 8 respectively sitting, in each case, on a communal shaft. Two toothed belts 6 are transported around the double-pulley pairs 7 and 8.

Several claws 5 form a comb-like claw edge 51 which is attached rigidly on two sides onto the two toothed belts 6. The claws 5, which are arranged in a comb-like manner engage, with the zone for the delivery or, as the case may be, the acceptance of the printed copies 2 in appropriate circumferential grooves 31 on the folding jaw cylinder 1. The separation between the two parallel running toothed belts 6 is smaller than the width of the printed copies 2 so that the edges of the printed copies 2, which project out on the two sides, are capable of being decelerated by the brake disks 10 and the brake-cams 11 which are arranged in a double sided manner on the outer sides of the toothed belts 6. Likewise, the stop-cams 14 run around on both sides of the second toothed pulley 8 on, in each case, an appropriate stop-cam belt.

Together with the brake and the stop-cam belt and also the laying out belt 13, the second toothed pulley 8 is mounted in bearings on a swivel arm 18 which is capable of swivelling about the axis of rotation of the first toothed pulley 7. Swivelling takes place by means of a motorized adjustment 19 but can also basically be achieved by means of manual adjustment.

The cylinder 1 with the folding valves is driven via a toothed wheel 21. The first toothed pulley 7 is driven via a further toothed wheel—sitting on the shaft of the cylinder 1 with the folding valves—via a toothed wheel 22 from the same power source and at the gear reduction for the speed of the toothed belt 6 which has been described. The toothed wheel 22 for driving the first toothed pulley 7 drives, for its part, an arrangement 23 consisting of several toothed wheels with different numbers of teeth. The drive toothed wheel 27 for the drive roller 12 of the laying out belt 13 mates with the innermost toothed wheel of this arrangement 23. The central and outer toothed wheels of the arrangement 23 mate alternatively with one of two toothed wheels 24 which are capable of being displaced in a parallel manner. This double arrangement of toothed wheels 24 is attached on a shaft in a manner whereby rotation takes place stiffly; however, it is mounted with bearings in a manner whereby it is capable of linear displacement. A further toothed wheel 25 is connected completely rigidly to the same shaft and serves in being driven on the drive toothed wheel 26 of the lower brake disk 11 and on the drive toothed wheel 29 of the toothed pulley 15 for driving the brake-cam 10 and the stop-cam belt. As a result of the displacement of the double toothed wheel 24, a choice can thus be made between two numbers of revolutions per unit time for the lower brake disk 11 and the toothed pulley 15 in order to be able, in this way, to adjust the brake for the copies to the two types of production-collection-production and double production. Propulsion of the components which are adjustable via the two swivel arms 18 takes place, in each case, via flexible drive shafts 15.

Figure 6:
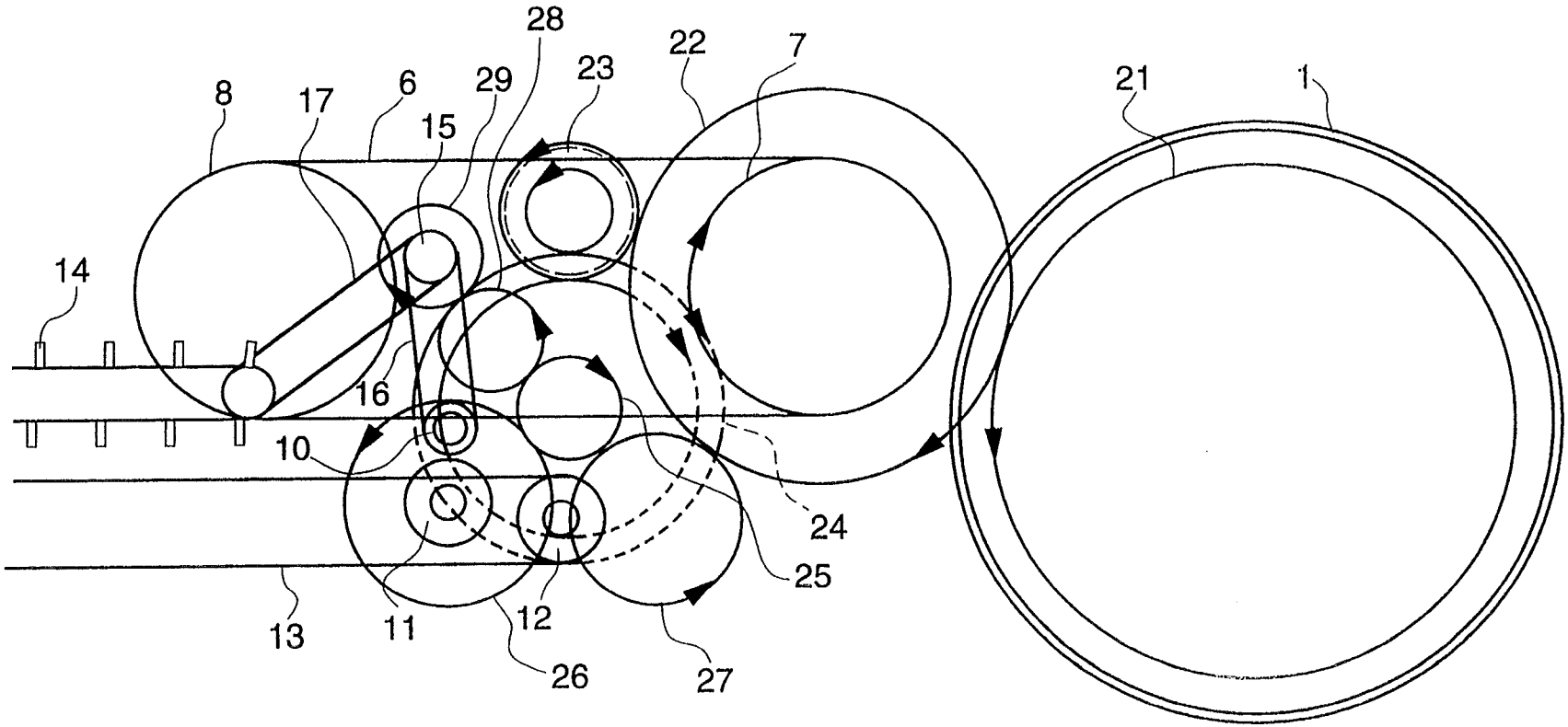
FIG. 6 is an arrangement of the rotating components of the device in accordance with FIGS. 1 and 2.

FIG. 6 shows the drive mechanism which has been described in the form of a schematic lateral view. The description which was given in connection with FIG. 2 applies with reference being made to the arrows, which are entered in FIG. 3, indicating the directions of rotation of the individual drive components and working components.

While a specific embodiment of the invention has been shown and described in detail to illustrate the application of the principles of the invention, it will be understood that the invention may be embodied otherwise without departing from such principles.

What is claimed is:

1. A device for the formation of a scale-like stream of folded printed copies, comprising:

a folding jaw cylinder moving folded printed copies along a folding jaw cylinder periphery;

a traction device;.

a traction device drive for moving said traction device relative to said cylinder;

a plurality of claws, each of said plurality of claws having a leading end connected to said traction device and having a trailing end, each trailing end cooperating with said traction device to define a slot-like intake;

claw moving means for moving said trailing end from an open position for receiving folded printed copies from said folding jaw cylinder to a closed position wherein said trailing end presses said traction device for clamping a folded printed copy between said claw and said traction device.

2. A device according to claim 1, wherein:

said slot-like intake defines an intake zone wherein said claws are bent in a concave manner relative to said traction device at said intake zone.

3. A device according to claim 1, wherein: said claws are connected rigidly to said traction device.

4. A device according to claim 1, wherein: said claws are constructed in one piece.

5. A device according to claim 1, wherein:

said traction device and said claws cooperate to define an elastic grasping means for grasping printed copies elastically.

6. A device according to claim 5, wherein:

said traction device is formed of an elastic material and said claws are formed of a material harder than said elastic material, said harder material including metallic material.

7. A device according to claim 1 further comprising:

deflecting means connected to said traction device, for changing the direction of transport of said traction device.

8. A device according to claim 7, wherein:

said deflecting means moves said traction device in an arc in a region for accepting printed copies from said folding jaw cylinder, said arc curving in a convex manner relative to said folding jaw cylinder.

9. A device according to claim 8, wherein: said arc is an arc of a circle.

10. A device according to claim 8, wherein:

a profile of a radius of curvature of said arc is changeable to adapt to different thicknesses of printed copies which are accepted from said folding jaw cylinder.

11. A device according to claim 7, wherein:

said deflecting means includes a circumference which corresponds substantially to three times a magnitude of a separation of said claws.

12. A device according to claim 7, wherein:

said deflecting means has an axis of rotation arranged to be higher than an axis of rotation of said :folding jaw cylinder, said folding jaw cylinder rotating in a direction opposite to that of said deflecting means.

13. A device according to claim 1, wherein:

said claws are distributed on said traction device with a distance between consecutive claws being approximately 70% of a separate of folding jaws of an outer circumference of said folding jaw cylinder.

14. A device according to claim 1, wherein:

said traction device is formed of an endlessly circulating toothed belt.

15. A device according to claim 1, wherein:

said folding jaw cylinder includes grooves extending in a circumferential direction, said claws having trailing extremities engaging said grooves during acceptance of a printed copy.

16. A device according to claim 1, further comprising:

a linear transporter for receiving the printed copies laid out in a scale-like stream, said traction device turning away from said linear transporter for releasing said printed copies.

17. A device according to claim 16, further comprising:

a brake acting on a trailing extremity of said printed copies, said brake being arranged upstream of a point of laying out said printed copies on said linear transporter.

18. A device according to claim 17, wherein:

said brake includes a brake disk formed of an elastic material and a brake cam acting from above said printed copies as said printed copies are transported over said brake disk.

19. A device according to claim 16, further comprising:

an endlessly circulating cam belt arranged said above said linear transporter, said cam belt having projected cams acting as stops for stopping a leading extremity of said printed copies.

20. A device according to claim 1, further comprising:

a guiding device provided below said traction device for guiding printed copies.

21. A device according to claim 20, wherein:

said guiding device extends into an accepting region whereat said printed copies are accepted by said traction device claws.

22. A device according to claim 1, further comprising:

a guide belt for guiding printed copies as they are transported from said folding jaw cylinder to said traction device.

23. A device according to claim 1, wherein said claw moving means includes deflecting means connected to said traction device, for changing a direction of transport of said traction device, said deflecting means causing said trailing end to ,move away from said traction device as said leading end, and a portion of said traction device connected to said leading end, are deflected by said deflecting device.

24. A process for forming a scale-like stream of folded printed copies, the process comprising the steps of:

providing a folding jaw cylinder;

moving printed copies along a periphery of said folding jaw cylinder;

providing a traction device with a plurality of claws, each claw cooperating with said traction device and forming a slot like intake between each claw and said traction device;

moving said traction device over a travel path wherein a trailing end of each claw moves in relation to said traction device over said travel path between a closed position wherein said trailing end is closely spaced to said traction device and an open position wherein said trailing end is spaced away from said traction device;

transferring printed copies from said folding jaw cylinder to said slot-like intake at a location wherein said claws are in an open position;

and moving said traction means to clamp said printed copies between said claw and said traction device.

25. A process according to claim 24, wherein:

said claws are driven continuously at a transportation speed which is 20 to 40% lower than a circumferential speed of said folding jaw cylinder.

26. A process according to claim 25, wherein:

said claws are driven continuously at a transportation speed which is 30 to 35% lower than the circumferential speed of said folding jaw cylinder.

27. The process according to claim 24, further comprising positioning a guide means underneath the traction device, the printed copies being clamped between the claws and the traction device is subsequently being delivered on to a scale-like stream on said guide means.

28. A process according to claim 27 wherein the printed copies are held at their leading extremities by said claws and a frictional force is exerted on trailing extremities of the printed copies during the course of their release for laying out the printed copies in the scale-like stream.

29. A process according to claim 24, wherein the printed copies are transported against stops in an aligned manner during the course of release from the claws up to the point of laying out the printed copies in the scale-like stream.

30. A process for the formation of a scale-like stream of folded printed copies, the process comprising the steps of:

providing a folding jaw cylinder;

moving folded printed copies along a folding jaw cylinder periphery;

providing a traction device with a plurality of claws, each claw cooperating with said traction device to define a slot-like intake zone therebetween;

transferring folded printed copies directly from said folding jaw cylinder to said the slot-like intake zone; and transporting said folded printed copies while being held between corresponding claws and said traction device up to a point of laying out said folded printed copies in a scale-like stream.

31. A device for the formation of a scale-like stream of folded printed copies, comprising:

a folding jaw cylinder moving folded printed copies along a folding jaw cylinder periphery;

a traction device, said traction device including a flexible endless belt;

a traction device drive for moving said traction device relative to said cylinder;

a plurality of claws, each of said plurality of claws having a leading end connected to said flexible belt and having a trailing end, each trailing end cooperating with said flexible belt to define a slot-like intake,;

deflecting means connected to said traction device, for changing the direction of transport of said traction device;

claw moving means comprising said deflecting means and said leading end connected to said flexible belt for moving said trailing end from an open position for receiving folded printed copies from said folding jaw cylinder to a closed position wherein said trailing end presses said traction device for clamping a folded printed copy between said claw and said traction device, said deflecting means causing said trailing end to move away from said flexible belt as said leading end and a portion of said flexible belt connected to said leading end are deflected by said deflecting device.

* * * * *